US012409972B2

(12) United States Patent
Everts et al.

(10) Patent No.: US 12,409,972 B2
(45) Date of Patent: Sep. 9, 2025

(54) PULL TAB FOR BEVERAGE CONTAINERS WITH ENHANCED ACCESSIBILITY AND ERGONOMICS

(71) Applicant: Intellectual Capital Management, Whitefish, MT (US)

(72) Inventors: Mitchell Everts, Whitefish, MT (US); Bryan Cook, Whitefish, MT (US)

(73) Assignee: Intellectual Capital Management, Whitefish, MT (US)

( * ) Notice: Subject to any disclaimer, the term of this patent is extended or adjusted under 35 U.S.C. 154(b) by 0 days.

(21) Appl. No.: 18/951,007

(22) Filed: Nov. 18, 2024

(65) Prior Publication Data

US 2025/0074651 A1 Mar. 6, 2025

Related U.S. Application Data

(63) Continuation-in-part of application No. 18/829,257, filed on Sep. 9, 2024, now Pat. No. 12,246,371, and (Continued)

(51) Int. Cl.
*B65D 17/34* (2006.01)
*B65D 17/28* (2006.01)

(52) U.S. Cl.
CPC ..... *B65D 17/4012* (2018.01); *B65D 17/34* (2018.01); *B65D 2517/0014* (2013.01)

(58) Field of Classification Search
CPC ..... B65D 17/4012; B65D 17/34; B65D 2517/0013; B65D 2517/0014; (Continued)

(56) References Cited

U.S. PATENT DOCUMENTS 3,938,696 A * 2/1976 Herbst ..... B65D 79/008 220/273
4,276,993 A * 7/1981 Hasegawa ..... B65D 17/4012 220/269

(Continued)

FOREIGN PATENT DOCUMENTS

KR 20010081390 A * 8/2001 ..... B65D 17/34
KR 200256157 Y1 * 12/2001 ..... B65D 17/34
KR 20190001361 U * 6/2019 ..... B65D 17/28

*Primary Examiner* — Gideon R Weinerth
(74) *Attorney, Agent, or Firm* — QuickPatents; Kevin Prince

(57) ABSTRACT

A pull tab for opening a container with a lidded frangible region and rivet is disclosed. The pull tab comprises a tapered body with a nose portion, lift portion, and opposing sides. A rivet island aperture defines a rivet island with a rivet aperture for lid attachment. The tab features two bends: one between the nose and lift portions, another between the rearward end and the first bend. The entire lift portion is elevated above the container lid, improving finger access. Total height from the bottom of the nose portion to the top of the lift portion ranges from 1 to 4 millimeters, allowing better lid stacking while maintaining usability. Various angles and bend positions optimize flexibility, durability, and ergonomics. An optional third bend creates an ergonomic contour. The tab's dimensions accommodate different lid sizes and user preferences, balancing comfort, opening efficiency, and compatibility with various container lid types.

28 Claims, 7 Drawing Sheets

Related U.S. Application Data a continuation-in-part of application No. 18/733,452, filed on Jun. 4, 2024, which is a continuation-in-part of application No. 18/236,703, filed on Aug. 22, 2023.

(60) Provisional application No. 63/537,633, filed on Sep. 11, 2023, provisional application No. 63/507,934, filed on Jun. 13, 2023, provisional application No. 63/507,938, filed on Jun. 13, 2023, provisional application No. 63/478,185, filed on Jan. 2, 2023.

(58) Field of Classification Search
CPC .... B65D 2517/0079; B65D 2517/5075; B65D 2517/0016; B21D 51/383; B21D 51/443; Y10S 220/906
USPC ..... 220/269, 270, 272, 273, 906; 215/255
See application file for complete search history.

(56) References Cited

U.S. PATENT DOCUMENTS 4,318,493 A * 3/1982 Jacobsen ..... B65D 17/4012 220/269
4,480,763 A * 11/1984 Schneider ..... B65D 17/4012 220/269
8,733,576 B2 * 5/2014 Jeon ..... B65D 17/4012 215/230
12,246,371 B1 * 3/2025 Everts ..... B21D 51/383
2002/0088804 A1 * 7/2002 Omura ..... B65D 17/4012 220/269
2004/0099665 A1 * 5/2004 McEldowney .... B65D 17/4011 220/276
2006/0196875 A1 * 9/2006 Cherian ..... B65D 17/4012 220/269
2007/0039961 A1 * 2/2007 McEldowney ..... B21D 51/383 220/269
2009/0095752 A1 * 4/2009 Mceldowney ..... B65D 17/4012 220/272
2010/0126994 A1 * 5/2010 Tielbeke ..... B21D 51/383 220/273
2010/0166528 A1 * 7/2010 McEldowney ..... B21D 51/383 413/66
2011/0186575 A1 * 8/2011 Dunwoody ..... B65D 17/4011 220/270
2012/0273492 A1 * 11/2012 Werth ..... B65D 17/4011 493/405
2018/0099794 A1 * 4/2018 Cohen Bissu ..... B65D 17/4012
2019/0112096 A1 * 4/2019 Gogola ..... B65D 17/4011
2021/0121936 A1 * 4/2021 Ohkoshi ..... B32B 15/20
2024/0216981 A1 * 7/2024 Everts ..... B21D 51/383
2025/0074651 A1 * 3/2025 Everts ..... B65D 17/4012
2025/0083213 A1 * 3/2025 Everts ..... B21D 51/383
2025/0083864 A1 * 3/2025 Everts ..... B65D 17/4012

* cited by examiner

PULL TAB FOR BEVERAGE CONTAINERS WITH ENHANCED ACCESSIBILITY AND ERGONOMICS

CROSS REFERENCE TO RELATED APPLICATIONS

The present invention is a Continuation-in-Part of U.S. Utility patent application Ser. No. 18/733,452, filed on Jun. 4, 2024, which itself is a Continuation-in-Part of U.S. Utility patent application Ser. No. 18/236,703, filed on Aug. 22, 2023, which claims the benefit of U.S. Provisional Patent Application 63/478,185, filed on Jan. 2, 2023, as well as U.S. Provisional Patent Application 63/507,934, filed on Jun. 13, 2023, as well as U.S. Provisional Patent Application 63/507,938, filed on Jun. 13, 2023. The present invention is further a Continuation-in-Part of U.S. Utility patent application Ser. No. 18/829,257 filed on Sep. 9, 2024, which itself claims the benefit of U.S. Provisional Patent Application 63/537,633, filed on Sep. 11, 2023. All of these applications are incorporated herein by reference.

STATEMENT REGARDING FEDERALLY SPONSORED RESEARCH AND DEVELOPMENT

Not Applicable.

FIELD OF THE INVENTION

The present invention relates to pull tabs for opening containers, particularly beverage cans, with an emphasis on improved ergonomics, user accessibility, and stacking compatibility.

BACKGROUND

Pull tabs are essential components of containers, such as beverage cans like beverage cans, providing consumers with an efficient means to open the container. Traditional pull tabs are generally flat and may require significant effort to actuate, potentially leading to a suboptimal user experience. Elevated lift-end pull tabs have been developed to address this issue by raising the lift portion of the tab for easier access.

Current elevated pull tabs frequently have upward bends isolated within the lift portion, which can interfere with stacking in predominately used commercial packaging systems. These designs may prevent effective stacking on beverage container lids, particularly when additional structural features such as "shadow beads" (protrusions on the lid) are present. Moreover, isolated bends in the lift portion of the tab may not provide the optimal finger access desired for user convenience.

Existing pull tab designs often struggle to balance user accessibility with stacking compatibility. The height of the lift portion and the placement of upward bends can create challenges in commercial packaging systems. Additionally, current designs may not adequately address the need for improved ergonomics, especially for users with limited dexterity. There is a need for a pull tab design that enhances user experience by providing easier access and actuation, while simultaneously ensuring compatibility with stacking requirements and various lid configurations. Such a design would ideally incorporate features that optimize flexibility, durability, and ergonomics without compromising the structural integrity of the container or interfering with existing manufacturing and packaging processes.

SUMMARY OF THE INVENTION

The present device is a pull tab for opening a container with a lid having a frangible region and a rivet. The pull tab comprises a body with a forward end including a nose portion, a rearward end including a lift portion, and opposing sides extending between them. The body is tapered, being thicker at the nose portion than at the lift portion.

A rivet island aperture in the body defines a rivet island with a rivet aperture for attachment to the container lid. The pull tab features a first bend between the nose portion and lift portion, and a second bend between the rearward end and the first bend. An intermediate portion lies between these bends.

The design elevates the entire lift portion above the container lid, enhancing finger access for improved user experience. The total height from the bottom plane of the pull tab to the top plane of the lift portion ranges from 1 to 4 millimeters. This design allows for better stacking of container lids while maintaining ease of use.

The pull tab may include a finger hole between the rearward end and the rivet island aperture. Various angles between different portions of the tab optimize its stacking compatibility with various lid types, flexibility, durability, and ergonomics. The positioning of the bends along the tab's length is designed to provide optimal leverage for opening containers as well enable stacking of lids with varying shadow bead geometries.

In certain embodiments, the pull tab features a variable thickness profile along the body between the nose portion and the first bend. This profile includes an intermediate thickness peak, where the thickness increases from the nose portion to a maximum thickness before tapering towards the lift portion. This design enhances user engagement and structural support, offering an ergonomic and flexible tab design for improved actuation.

An optional third bend at the rearward end of the lift portion creates an ergonomic contour for improved grip. The width and length of the pull tab are designed to accommodate various lid sizes and user preferences, as well as streamlined manufacturing capabilities by enabling cost effective retrofitting processes to enable their manufacturing on conversion press systems.

The present invention addresses the drawbacks of the prior art by providing a pull tab design that effectively balances user accessibility with stacking compatibility. This innovative design incorporates strategically placed bends on the sides of the pull tab and a tapered body structure that enhance user experience by providing easier access and actuation, while simultaneously ensuring compatibility with stacking requirements and various lid configurations. The pull tab features an elevated lift portion that improves finger access without compromising stacking efficiency. By optimizing the angles and positioning of the bends, the invention achieves improved flexibility, durability, and ergonomics without compromising the structural integrity of the container. The design is compatible with existing manufacturing and packaging processes, making it a practical solution to the longstanding challenges in pull tab design.

This invention particularly benefits users with limited dexterity, offering a more comfortable and efficient means of opening containers while addressing the commercial needs of stackability and versatility across different container types. Other features and advantages of the present invention will become apparent from the following more detailed description, taken in conjunction with the accompanying drawings, which illustrate, by way of example, the principles of the invention.

DETAILED DESCRIPTION

Illustrative embodiments of the invention are described below. The following explanation provides specific details for a thorough understanding of and enabling description for these embodiments. One skilled in the art will understand that the invention may be practiced without such details. In other instances, well-known structures and functions have not been shown or described in detail to avoid unnecessarily obscuring the description of the embodiments.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list. When the word "each" is used to refer to an element that was previously introduced as being at least one in number, the word "each" does not necessarily imply a plurality of the elements, but can also mean a singular element. When the words "substantially" or "about" are used, if a quantitative measurement is necessary, within 95% of "complete" or "exact" should be considered the meaning. The term "the invention" or "the present invention" should always be construed as "an embodiment of the invention."

Figure 1:
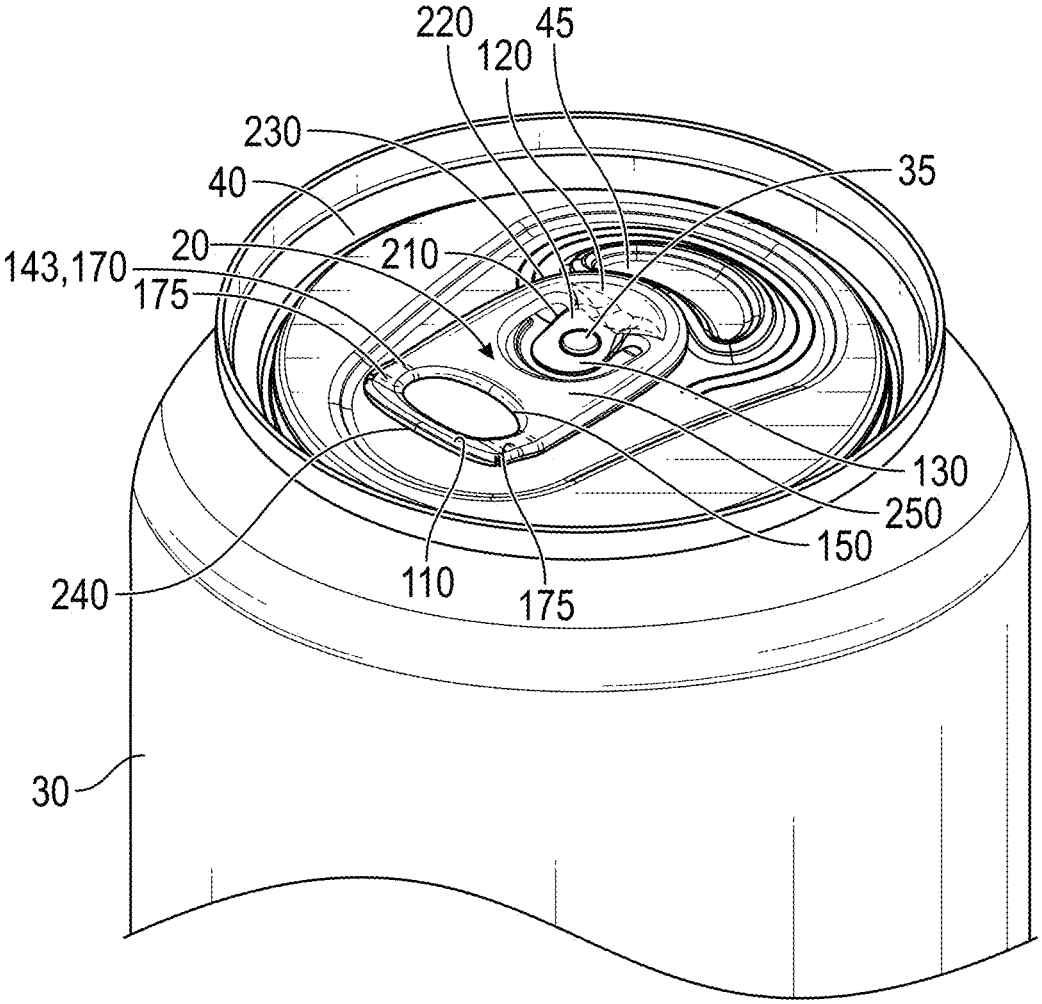
FIG. 1 is a perspective view of the invention as fixed with a lid of a container.
Figure 2:
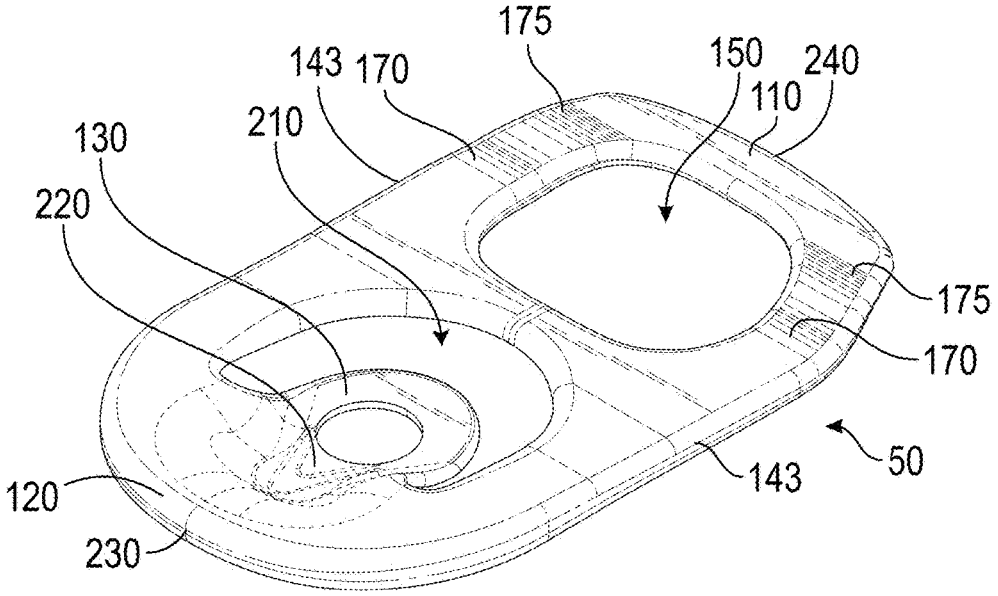
FIG. 2 is a front perspective view of one embodiment of the invention.
Figure 3:
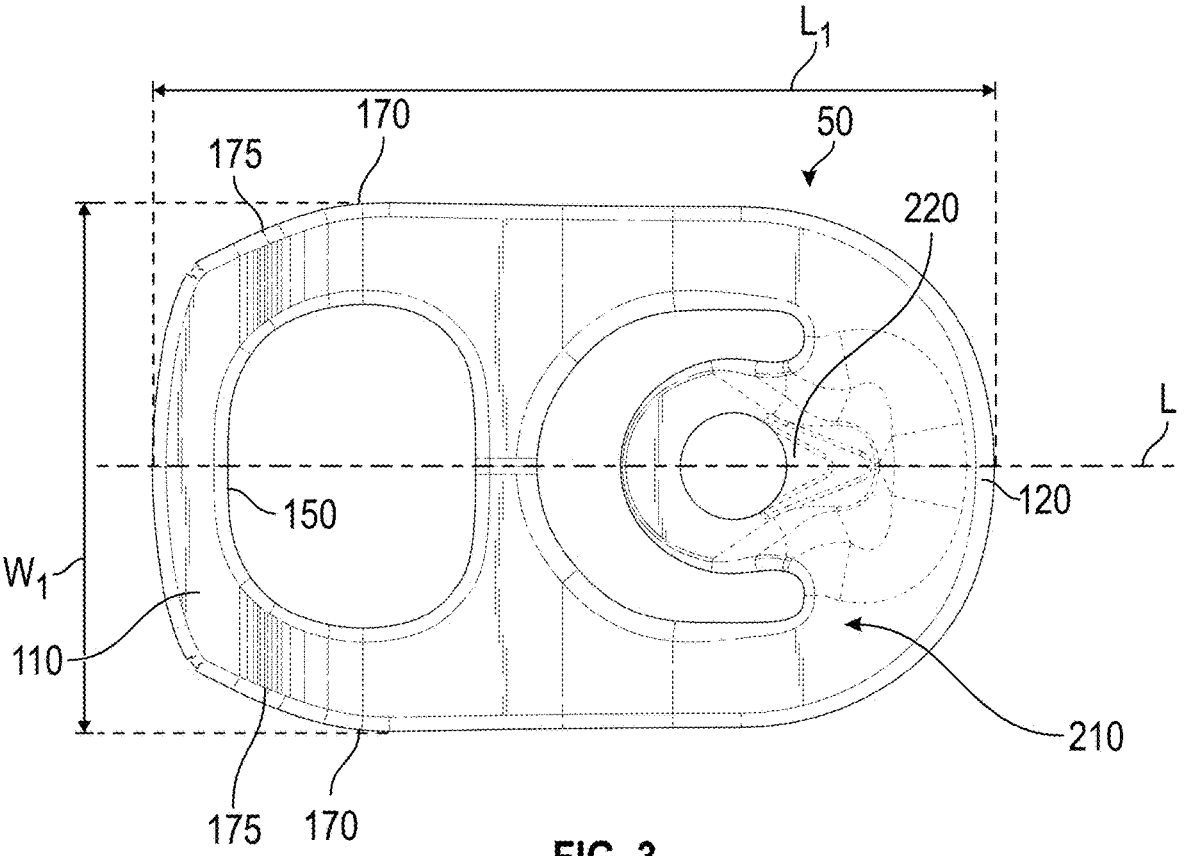
FIG. 3 is a top plan view of the embodiment of FIG. 2.
Figure 4A:
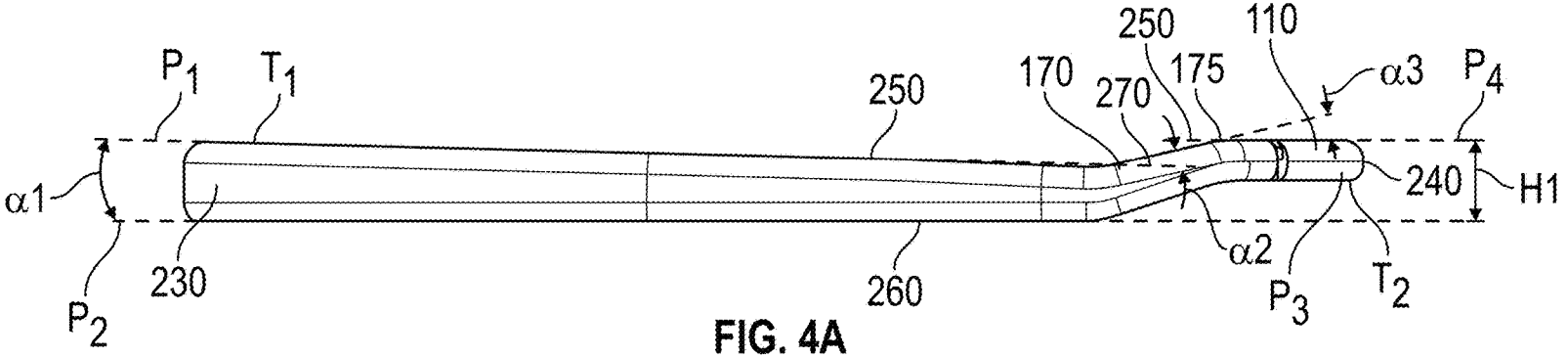
FIG. 4A is a side elevational view of the embodiment of FIG. 3, showing a first bend and a second bend to create an elevated lift portion.
Figure 4B:
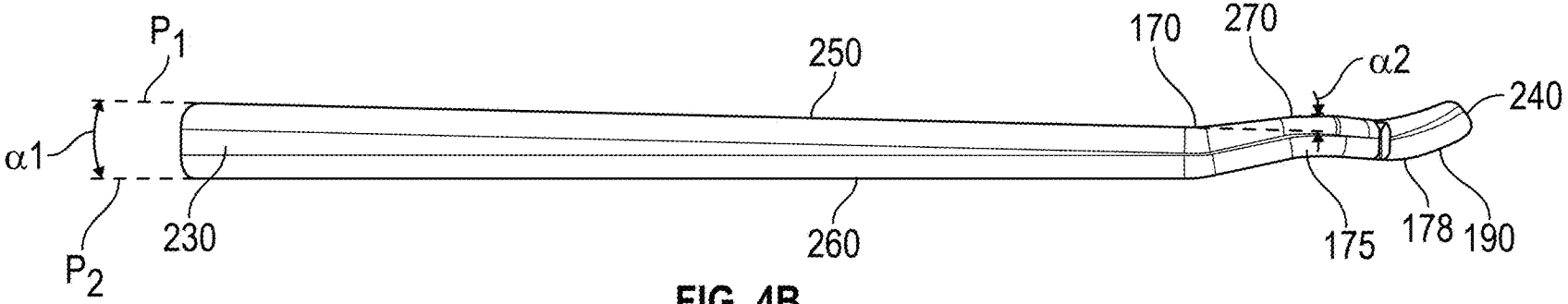
FIG. 4B is a side elevational view of an alternate embodiment of the invention, having a third bend and an ergonomic contour.
Figure 4C:
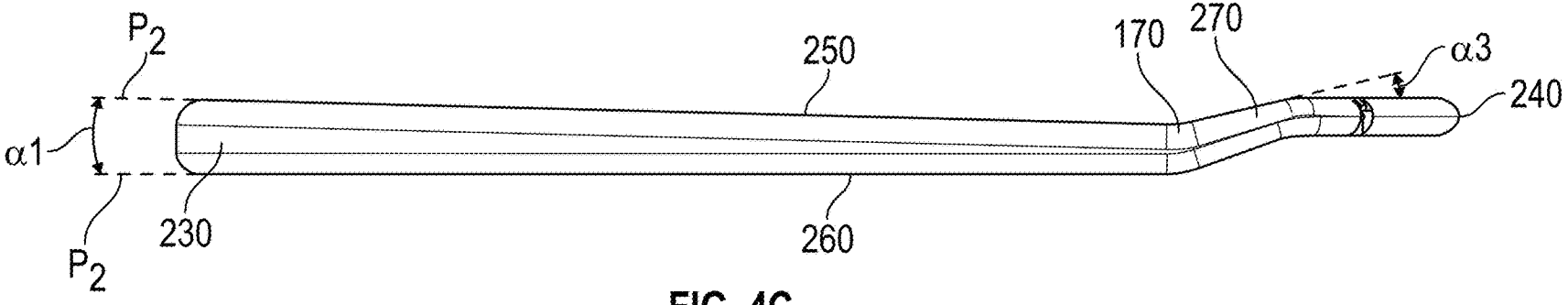
FIG. 4C is a side elevational view of another alternate embodiment of the invention.
Figure 4D:
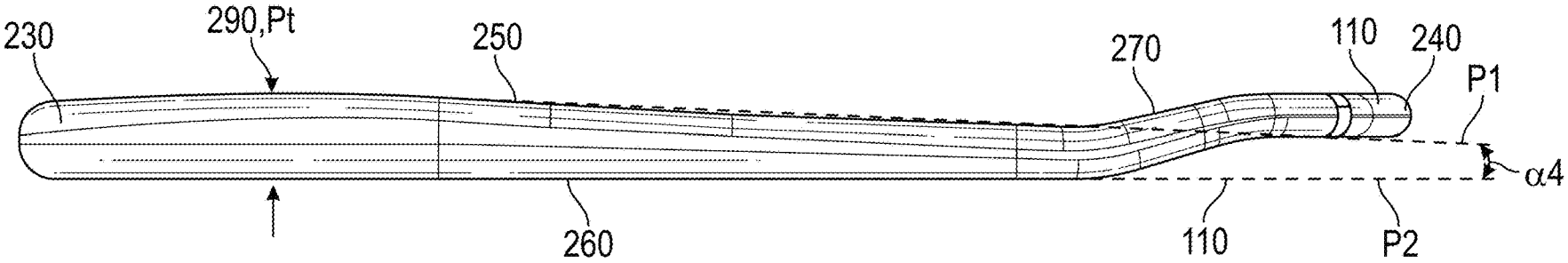
FIG. 4D is a side elevational view of yet another alternate embodiment of the invention wherein a top plane and a bottom plane form a tapering angle.
Figure 4E:
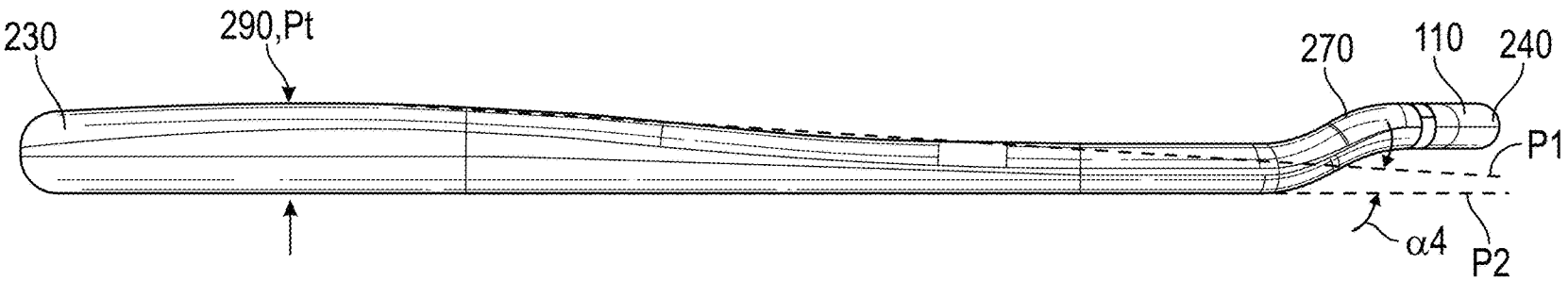
FIG. 4E is a side elevational view of an alternate embodiment of the pull tab having the tapering angle.

FIGS. 1-3 illustrate a pull tab 20 for opening a container 30 of the type having a container lid 40 with a frangible region 45 and a rivet 35. The pull tab 20 comprises a body 50 having a forward end 230 that includes a nose portion 120, a rearward end 240 that includes a lift portion 110, a pair of opposing sides 143 extending from the nose portion 120 to the lift portion 110, a top surface 250 defining a top plane $P_1$, and a bottom surface 260 defining a bottom plane $P_2$. A longitudinal axis L of the body 50 is defined between the forward end 230 of the body and the rearward end 240 of the body. The body 50 is tapered such that a thickness $T_1$ (FIGS. 4A-4E) of the body 50 at the nose portion 120 between the top surface 250 and the bottom surface 260 is thicker than a thickness $T_2$ of the body 50 between the top surface 250 and the bottom surface 260 at the lift portion 110. The body 50 may be made of aluminum, tin, or steel, with the most common material being aluminum 5182-H19 or H32.

A rivet island aperture 210 is formed in the body between the opposing sides 143 of the body proximate the nose portion 120. The rivet island aperture 210 defines a rivet island 130 of the body 50 that includes a rivet aperture 135 for attachment with the rivet 35 of the container lid 40, and a transition area 220 between the rivet aperture 135 and the forward end 230.

A first bend 170 is formed in the body between the nose portion 120 and the lift portion 110. A second bend 175 is formed in the body 50 between the rearward end 240 of the body and the first bend 170. The lift portion 110 is disposed between the rearward end 240 of the body 50 and the second bend 175. An intermediate portion 270 of the body 50 is defined between the first bend 170 and the second bend 175. The bottom surface 260 of the lift portion 110 defines a lift portion bottom plane $P_3$ (FIGS. 4A-4C), and the top surface 250 of the lift portion 110 defines a lift portion top plane P4. The lift portion bottom plane $P_3$ is substantially parallel to a bottom plane $P_2$ of the nose portion 120. The positioning of the first bend 170 and second bend 175, as illustrated, is specifically designed to achieve an optimal balance between leverage and stacking compatibility. The first bend 170, positioned at an ideal location along the body, creates the necessary lift for ergonomic engagement while ensuring the pull tab remains compact enough for effective stacking. The second bend 175 further elevates the lift portion 110, facilitating improved finger access without excessive height that could interfere with commercial packaging. This strategic placement of the bends 170,175 ensures compatibility with shadow bead configurations on various container lids 40, enabling both enhanced user accessibility and manufacturability.

Figure 5:
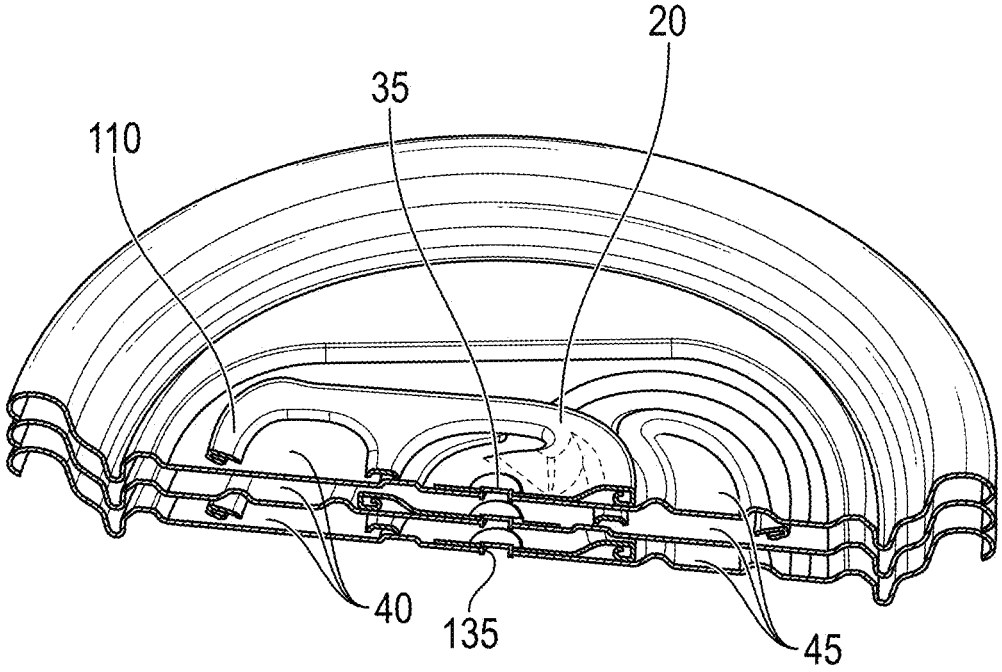
FIG. 5 is a cross-sectional view, along the longitudinal axis of the pull tabs, of a stack of the container lids having the invention fixed thereto with a rivet.

A total height $H_1$ from the bottom plane $P_2$ to the lift portion top plane $P_4$ is between 1 millimeter and 4 millimeters. Such a height range allows the pull tab 20 to accommodate lids with greater depth, enabling stacking across a variety of lid types (FIG. 5). The increased flexibility in height ensures that tabs can work with containers that have different distances between stacked end panels. This specific height range of 1 to 4 millimeters was chosen to provide a balanced elevation that improves user accessibility while minimizing the risk of accidental openings during stacking and shipment. Setting the height within this range allows the pull tab 20 to align with commercial shadow bead configurations, avoiding interference with adjacent lids 40 in stacked arrangements. This careful height adjustment enhances the versatility of the pull tab 20 across different container designs, ensuring it meets both ergonomic and logistical requirements.

When the lift portion 110 is lifted away from the container lid 40, the nose portion 120 applies downward pressure on the frangible region 45 of the container lid 40 to open the container 30. The rivet 35 and rivet island 130 work to create a fulcrum (not shown) when the lift portion 110 is lifted upwardly away from the container lid 40, resulting in the nose portion 120 having sufficient leverage to break away the frangible region 45 of the container lid 40. This process is well known in the art, but the lift portion 110 being elevated above the container lid 40 provides greater finger access under the pull tab 20 to facilitate opening of the container 30.

The pull tab 20 may further include a finger hole 150 formed in the body 50 between the opposing sides 143 of the body 50 between the rearward end 240 of the body 50 and the rivet island aperture 210. The first bend 170 and the second bend 175 may be incorporated on opposing sides of the finger hole 150. This configuration, with the bends 170,175 on each side of the finger hole 150, serves to elevate the entire lift portion 10 of the pull tab 20 above the container lid 40, creating an expanded finger access area. By positioning the bends 170,175 in this manner, the design maximizes the accessible surface area for finger engagement, which reduces the strain required for actuation and enhances user comfort. Additionally, placing the bends 170,175 strategically around the finger hole 150 provides structural support, ensuring that the pull tab 20 remains durable during repeated use while aligning with the stacking requirements of commercial container lids 40.

The top plane $P_1$ and the bottom plane $P_2$ may form an angle $\alpha_1$ of between 2 degrees and 10 degrees from the nose portion 120 to the first bend 170. This angle creates a tapered design that enhances the tab's flexibility. A steeper angle increases flexibility, which can be preferred by manufacturers and consumers depending on the desired user experience. This range also accounts for varying shadow bead profiles, the metal protrusions underneath lids that differ across container designs, ensuring compatibility with a broad range of lid types. By allowing a range of 2 to 10 degrees, this design accommodates all known lid types currently in use within the industry, enabling viable stacking configurations across diverse container types. Furthermore, this angle range allows the design to balance material efficiency, as steeper angles minimize metal usage, reducing material costs and improving sustainability, while still supporting structural integrity to withstand repeated use.

The angle $\alpha$1 may be between 4 degrees and 5 degrees. Such a more specific angle within this range optimizes the balance between flexibility and rigidity, making the tab both user-friendly and durable. This narrower range helps to maintain consistent manufacturing standards while ensuring compatibility with typical lid designs. This specific range is well-suited to the most predominant container types on the market, ensuring that the pull tab is durable enough for everyday handling without excess material. This range is particularly favorable for standard lids 40 that feature shallower shadow beads 48, providing a robust structural profile that maintains strength even with minimized material use.

The angle $\alpha$1 may be about 4.34 degrees. Such an angle provides an optimal balance of flexibility and structural integrity. This precise angle represents the most universal taper for common lid types, offering optimal compatibility across a vast majority of commercially used container lids 40. The 4.34° angle achieves the ideal taper for efficient stacking, user accessibility, and minimized metal use, balancing both sustainability and durability. Any angle beyond this refined range could either reduce structural strength, impacting usability, or increase material use, affecting sustainability and cost. Thus, 4.34 degrees, we have found, offers the best compromise between functionality, structural viability, and cost-effectiveness.

Figure 6:
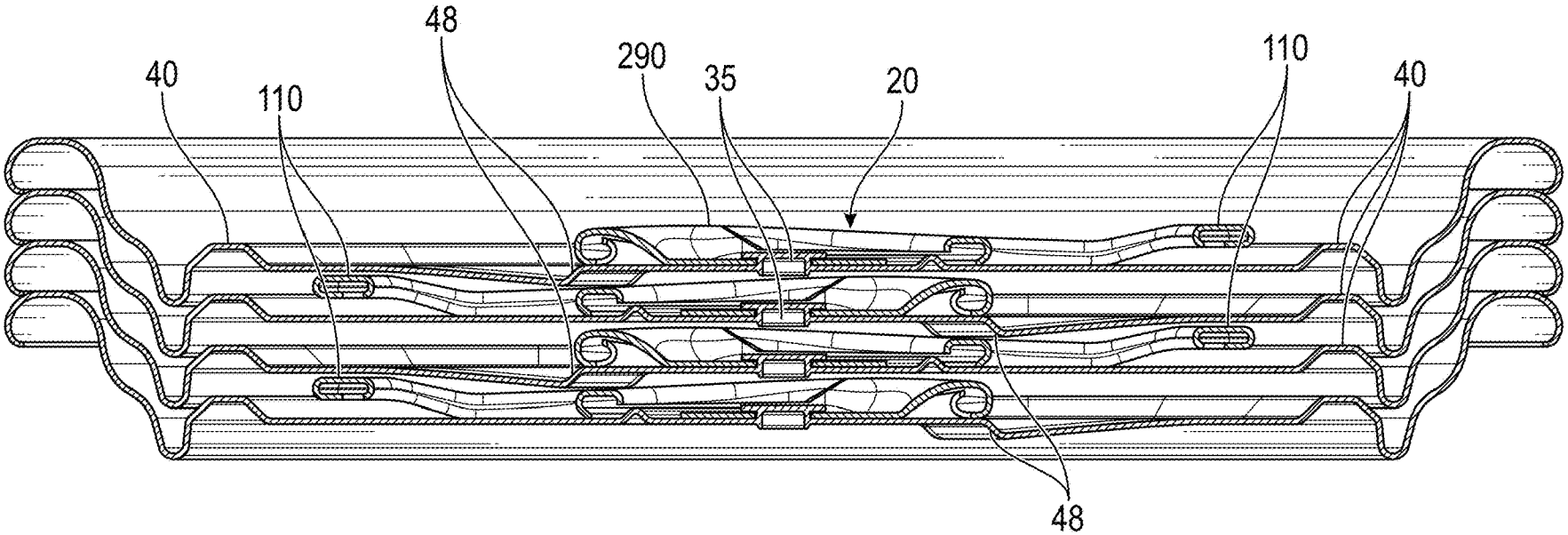
FIG. 6 is a cross-sectional view, along the longitudinal axis of the pull tabs, showing the embodiment having a tapering angle utilized in a stack of the container lids.
Figure 7A:
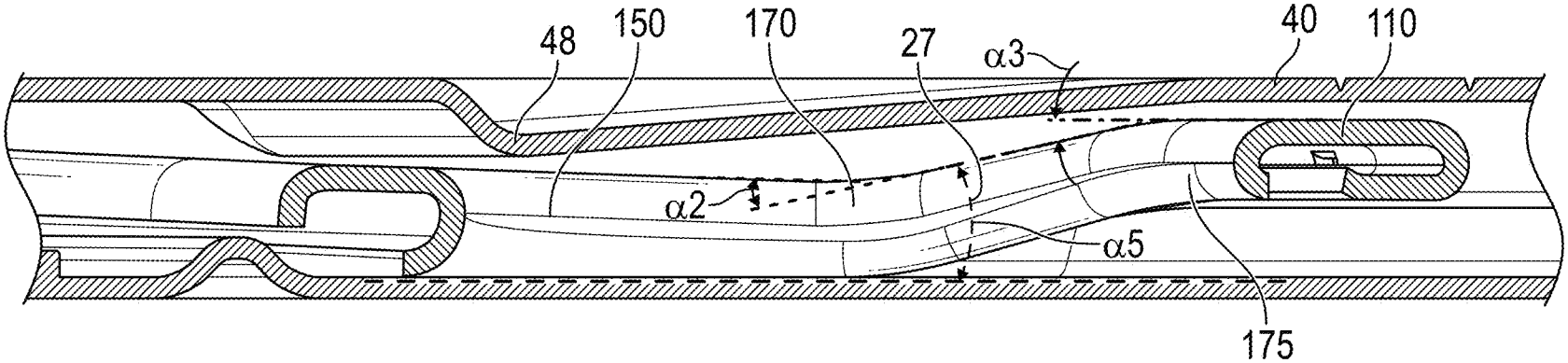
FIG. 7A is an enlarged, partial cross-sectional view, along the longitudinal axis of the pull tabs, of an embodiment angled to miss a shadow bead of one of the container lids stacked above.
Figure 7B:
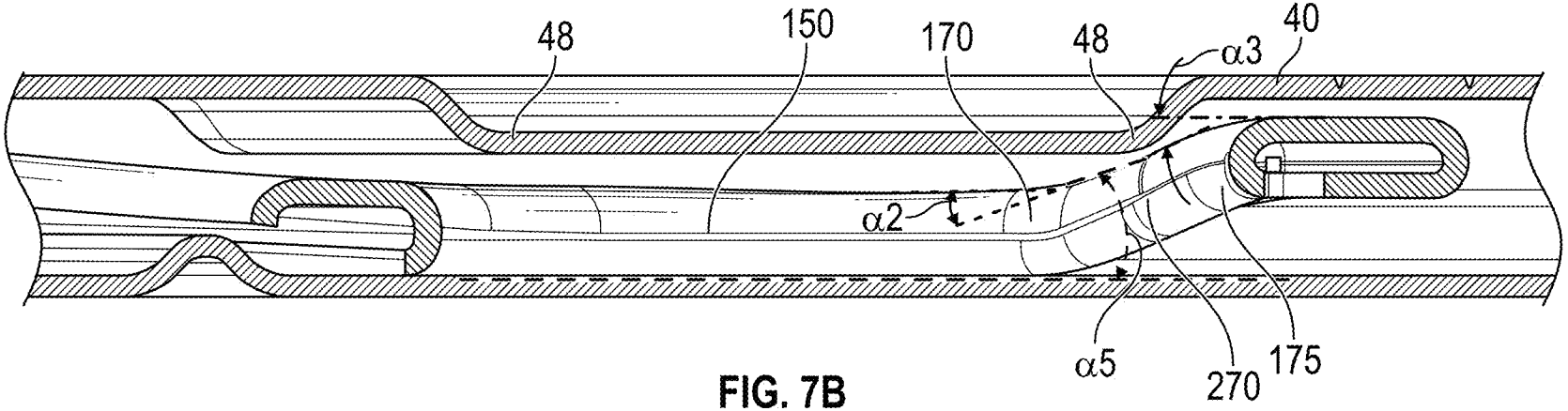
FIG. 7B is an enlarged partial cross-sectional view, along the longitudinal axis of the pull tabs, of an alternate embodiment angled to miss two of the shadow beads of one of the container lids stacked above.

In some preferred embodiments, the top plane $P_1$ and the bottom plane $P_2$ may form a tapering angle $\alpha$4 (FIGS. 4D, 4E) from the first bend 170 to the topmost point 290 of the tab at the peak thickness $P_T$. This tapering angle $\alpha$4 varies between 0.2 degrees and 5.6 degrees, designed to create a gradual taper that enhances the tab's stackability and maintains compatibility with various shadow bead designs, including those with downward protruding shadow beads 48 (FIGS. 6, 7A, and 7B). A steeper tapering angle $\alpha$4 closer to the upper end of this range, such as 2.5 degrees, can ensure optimal stackability and minimize interference with shadow bead 48 profiles. Extensive testing has shown that this range, from 0.2 to 5.6 degrees, represents the minimum and maximum viable angles for a taper that supports structural integrity, efficient stacking, and flexibility required for user actuation. By using this specified range, the design achieves compatibility across the most commonly used lid configurations while maintaining the structural strength necessary for sustained functionality. A lift angle $\alpha$5 (FIGS. 7A-7B) represents an angle between the intermediate portion 270 and the top plane $P_4$ of the lift portion. The lift angle $\alpha$5 was selected to provide additional elevation of the lift portion, ensuring compatibility with lids that feature prominent shadow bead geometries. Furthermore, this angle is optimized to maintain structural viability while allowing for high-speed conversion press manufacturing, where overly sharp angles could increase wear on tooling, potentially leading to costly repairs and downtime.

The tapering angle $\alpha$4 may be narrowed to a range between 1.5 degrees and 2.5 degrees. This more specific range optimizes the balance between stackability and structural rigidity, ensuring the tab remains user-friendly while maintaining its functional integrity. Manufacturers may prefer this narrower range to maintain consistent manufacturing standards and ensure reliable performance across different container lid configurations.

This range enables manufacturers to achieve an optimal balance between flexibility and material use, providing options for either increased flexibility with less material or enhanced structural strength with a slightly steeper taper. Additionally, the 1.5 to 2.5 degree range aligns well with predominant shadow bead geometries, maximizing stacking compatibility across widely used container lids 40.

The tapering angle $\alpha$4 may be about 2.1 degrees, which provides an ideal balance for universal stackability and structural support, ensuring that the pull tab 20 engages efficiently with lids featuring shadow beads 48 without sacrificing ease of use. After extensive evaluation and modeling, the 2.1 degree tapering angle was identified as the optimal angle for this design, providing the highest level of performance for both stacking compatibility and structural strength. This angle offers a structurally viable taper that minimizes material use without compromising durability, making it a preferred embodiment for universal application across commercial lid designs.

The intermediate portion 270 of the body 50 may form an angle $\alpha$2 with the top plane $P_1$ of between 5 degrees and 34 degrees. This angle allows manufacturers to fine-tune ergonomic considerations based on user preference. A shallower angle offers a gradual lift for comfort, while a steeper angle provides better leverage during opening. This broad range supports ergonomic customization while remaining functional across a range of containers. Comprehensive analysis has demonstrated that this range provides optimal compatibility with a variety of shadow bead geometries, which vary in shape, contour, and depth across different lid designs. Additionally, this angle range minimizes wear in high-speed conversion press tooling, ensuring the pull tab remains structurally viable for sustained manufacturing efficiency. By accommodating these industry-specific requirements, this angle range offers flexibility to manufacturers while maintaining consistency with commercial lid standards.

The angle $\alpha 2$ may be about 15 degrees. Such an angle is one preferred embodiment, striking a balance between ergonomic efficiency stacking capabilities with prominent shadow bead geometries and structural support. It provides optimal finger access while ensuring that the pull tab remains robust enough for frequent use, making it suitable for both carbonated and non-carbonated beverages. Detailed modeling has indicated that 15 degrees is the optimal angle for balancing stacking compatibility, tooling durability, and ergonomic functionality. This angle creates an ideal elevation of the lift portion relative to the body of the tab, maximizing finger access within the constraints of current lid designs. This configuration achieves the maximum allowable access area while aligning with the durability and flexibility required for frequent, user-friendly opening of both carbonated and non-carbonated containers.

The intermediate portion 270 of the body 50 may form an angle $\alpha 3$ with the lift portion top plane $P_4$ of between 10 degrees and 45 degrees. This angle range provides the optimal balance between structural integrity, finger accessibility, and tooling longevity in high-speed conversion press environments. Angles narrower than 10 degrees may lead to excessive wear on tooling, as well as increase the likelihood of the tab stock metal fracturing, while angles exceeding 45 degrees could interfere with stacking configurations, especially regarding the alignment with shadow bead geometries. This range is also essential to prevent the pull tab from contacting the top of the lid in stacked configurations, avoiding "sponginess" and preserving the protective coatings on the end panels of adjacent lids. This prevention of direct contact ensures that more lids 40 can fit into shipping sleeves, which improves logistical efficiency and maintains the structural and taste integrity of the can contents.

The angle $\alpha 3$ may be about 13 degrees, wherein the lift portion top plane $P_4$ is substantially parallel to the bottom plane $P_2$. After testing and iterative modeling, the 13° angle was identified as the optimal configuration for balancing structural durability, efficient stacking, and user-friendly finger access relative to the can lid 40. This specific angle maximizes the lift portion's elevation to provide the maximum allowable finger access while remaining compact enough to avoid sponginess when lids are stacked. This careful alignment minimizes the risk of accidental coating removal on the end panels of adjacent lids, which could otherwise compromise the safety and quality of the can contents. Additionally, aligning the lift portion top plane $P_4$ to be substantially parallel to the bottom plane $P_2$ achieves a compact and stable design, allowing the bottom plane $P_2$ of the pull tab 20 to sit flush against the flat end panel of the lid below. This parallel plane configuration not only conserves vertical space in stacked arrangements but also minimizes the likelihood of accidental openings by creating a low-profile lift portion 110 that resists snagging. By achieving this balance between angle and alignment, the design results from non-obvious insights specific to commercial stacking, high-speed manufacturability, and optimized user access, yielding a pull tab 20 that excels across these critical factors.

A vertical distance from the lift portion top plane $P_4$ to the lift portion bottom plane $P_3$ may be between 0.5 millimeters and 1 millimeter. Such a thickness range ensures the lift portion remains durable while providing a comfortable tactile feel. Thinner lift portions can enhance finger access, while slightly thicker sections improve the pull tab's structural integrity, accommodating various user preferences and manufacturing needs. Thicknesses below 0.5 millimeters risk fracturing during high-speed conversion press manufacturing, as thinner material may lack the necessary resilience for repeated stamping and handling. Conversely, a lift portion thickness greater than 1 millimeter does not yield substantial additional finger access and may limit the available space for users to reach underneath the pull tab 20. The thinner profiles within this range provide enhanced finger access by increasing the space between the pull tab 20 and the can lid surface, while thicker profiles add structural integrity to prevent deformation. This range also accommodates a variety of user and customer preferences, as some may favor the improved ergonomics and material economy provided by a thinner lift portion 110, while others may prefer the durability and substantial feel of a slightly thicker lift portion 110.

The vertical distance from the lift portion top plane $P_4$ to the lift portion bottom plane $P_3$ may be between 0.7 millimeters and 0.8 millimeters. This optimal thickness range of 0.7 to 0.8 millimeters represents the ideal balance between finger access beneath the pull tab 20 and the structural integrity required for reliable performance. This range not only minimizes the risk of fracturing during manufacturing but also optimally balances finger surface area contact with available reach underneath the pull tab 20. By incorporating a slightly thinner lift portion compared to traditional pull tabs, this novel configuration offers a superior balance of durability, ergonomic comfort, and material efficiency. This thickness range also enhances the pull tab's sustainability profile by using less metal without compromising structural strength, setting it apart from conventional elevated lift-in tabs currently on the market.

The thickness $T_1$ at the nose portion 120 may be between 1 millimeter and 2 millimeters. This range is critical for maintaining the structural integrity of the nose, which directly impacts the tab's ability to interact effectively with the frangible region 45 of the container lid 40. The thickness $T_1$ of the nose portion 120 is essential for providing the structural support and optimal opening properties required for different can contents, such as carbonated and vacuum-sealed products. A thinner nose portion 120 within this range optimizes material use, thereby reducing production costs and minimizing shipping weight, while still providing sufficient force transmission needed to open containers 30 with certain opening properties. However, a thicker nose portion 120 supports opening properties required for more demanding vacuum-sealed containers, ensuring the tab's durability under increased internal pressure conditions. This range thus provides the versatility needed for a broad spectrum of container designs.

The thickness $T_1$ of the nose portion 120 may be between 1.2 millimeters and 1.8 millimeters. Testing has shown this refined range of 1.2 to 1.8 millimeters was identified as optimal for balancing durability, material efficiency, and adaptability to different lid types. The elevated lift-in pull tab design allows users to apply a greater and more distributed force than with traditional flat tabs, thanks to improved ergonomics and increased under-tab finger access. Consequently, the structural integrity of the nose portion 120 must be robust enough to handle this enhanced interaction without compromising the structural integrity of the pull tab 20. This range provides manufacturers with the flexibility to adjust nose thickness $T_1$ based on the end-user requirements and opening properties of specific containers, ensuring compatibility with both carbonated and non-carbonated applications while meeting evolving standards in lid technology.

The thickness $T_1$ of the nose portion 120 may be about 1.35 millimeters. This specific thickness of 1.35 millimeters was determined to be the ideal choice for achieving a balance between opening properties, structural strength, and material efficiency. At 1.35 millimeters, the nose portion 120 offers the optimal thickness $T_1$ for effective interaction with the frangible region 45, supporting ergonomic improvements in user access while conserving material. This thickness $T_1$ minimizes material usage and weight without sacrificing the durability required for diverse container contents, setting it apart as an ideal configuration within the proposed elevated lift-in pull tab design.

The body 50 of the pull tab 20 in certain embodiments may have a variable thickness profile between the nose portion 120 and the first bend 170. Specifically, a thickness $T_1$ at the nose portion 120 between the top surface 250 and the bottom surface 260 may be approximately 1.35 millimeters, increasing to a peak thickness $T_P$ of about 1.5 millimeters at an intermediate location at the topmost point 290, before tapering down to about 0.75 millimeters at the lift portion 110. This novel variable thickness profile is essential for balancing structural integrity, user accessibility, and compatibility with a wide variety of container lid types. As the user lifts the lift portion 110 of the elevated pull tab 20, the increased thickness near the sides of the tab body provides the structural support necessary for the tab to interact effectively with the end panel and frangible region 45 of the container lid 40. The first points of contact with the lid 40 are the thicker sections on the sides of the tab, rather than the nose tip, which distributes the force across the strongest areas of the tab to optimize opening mechanics and durability.

The gradual tapering of the tab's thickness from the peak thickness $T_P$ down to the thinner lift portion 110 also enhances flexibility, a key improvement over traditional flat tabs, which tend to be rigid and difficult to bend. This increased flexibility not only reduces the perceived force needed for opening but also improves user ergonomics, allowing for easier access under the lift portion. By achieving a thinner profile toward the lift end, the design ensures that users can more comfortably engage with the pull tab 20, gaining more finger access without the rigidity of thicker, flat pull tabs. Additionally, the flexibility afforded by the thinner lift portion 110 creates a more forgiving and ergonomic opening experience, especially for users with limited dexterity.

The tapered thickness profile further contributes to material efficiency by requiring less metal in the lift portion, making the design more sustainable and cost-effective without compromising on strength. This efficient material use makes the present invention more economically viable than current easy-access pull tabs on the market, which often use more metal and struggle with stacking due to incompatibility with common shadow bead geometries. The proposed variable thickness profile enables compatibility with a broad range of shadow bead designs, supporting seamless stacking while providing an elevated lift portion that maximizes finger access—a significant improvement over prior art. This innovative balance between structural integrity, stacking capability, and enhanced user access sets the proposed invention apart as a commercially viable solution for elevated lift-in pull tabs, optimized for ergonomic use and compatibility with existing packaging standards.

The first bend 170 may be positioned between 19.25 millimeters and 21.5 millimeters along the longitudinal axis L from the forward end 230. This carefully defined range ensures that the first bend 170 does not interfere with predominantly used shadow bead geometries, maintaining stacking viability and preventing undesirable interactions with the shadow bead 48. If the first bend 170 is positioned closer to the forward end 230 than 19.25 millimeters along the longitudinal axis L, the upward bend would likely make contact with the shadow bead 48 during stacking, which could rub off protective coatings applied to the container lid 40 and cause "sponginess" in stacked arrangements. Sponginess results from contact between the tab and the lid of the neighboring container lid 40H and can reduce the number of lids 40 that fit within a shipping sleeve, leading to increased logistical costs. Additionally, a first bend 170 positioned closer than this minimum distance would create an overly large under-tab cavity, increasing the risk of accidental openings due to snagging. This 19.25 millimeter minimum distance was carefully selected to balance stacking compatibility, coating protection, and accidental opening prevention, ensuring the pull tab 20 remains functional and reliable under common usage conditions.

Conversely, a first bend 170 positioned at the upper limit of 21.5 millimeters along the longitudinal axis L provides optimal under-tab finger access while minimizing the likelihood of accidental openings. This positioning supports a well-defined finger access window that does not leave an overly exposed under-tab cavity, thus avoiding inadvertent openings caused by external forces. By locating the first bend 170 within this range, particularly at the upper end, the design maximizes user engagement with the pull tab 20 while maintaining the critical distance needed to prevent interference with shadow beads 48. This upper limit of 21.5 millimeters ensures that the pull tab 20 can be stacked effectively without contact or abrasion with shadow beads 48, offering an ideal balance of accessibility, ergonomic usability, and stacking compatibility.

The first bend 170 may be positioned about 19.3 millimeters along the longitudinal axis L from the forward end 230. This specific positioning is particularly suited for lids 40 with angular shadow bead geometries, which are common in the industry. Setting the first bend 170 at 19.3 millimeters along the longitudinal axis L initiates the elevation of the lift portion 110 at the ideal point, allowing the pull tab 20 to clear the shadow bead 48 and form an effective under-tab finger access window. This placement begins the upward bend 170 precisely where needed to optimize the interaction between the pull tab 20 and the container lid 40, ensuring that the lift portion 110 remains compact enough to prevent snagging or accidental openings. Positioning the first bend 170 at this distance supports the ideal alignment needed for stacking, helping maintain coating integrity on adjacent lids by reducing direct contact with the shadow bead 48. The chosen distance thus balances stacking capability and ergonomic finger access with the pull tab.

The first bend 170 may be positioned about 21.5 millimeters along the longitudinal axis L from the forward end 230. This placement is particularly suited to fully sunk shadow bead geometries, which feature a rectangular or square-shaped downward protrusion on the container lid. Positioning the first bend 170 closer than 21.5 millimeters would risk the upward bend coming into direct contact with the shadow bead 48, which could lead to coating abrasion, stacking instability, and reduced shipping efficiency. Additionally, a shallower position for the first bend 170 would create an under-tab cavity large enough to increase the risk of accidental openings from snagging or external forces. By setting the bend at 21.5 millimeters, the design avoids interference with the shadow bead 48, enabling the pull tab to nest securely in stacked configurations and maintain the protective coatings on adjacent lids. At this distance, the first bend 170 also initiates the elevation of the lift portion 110, creating a reliable under-tab finger access area that enhances both stacking capability and ease of use for fully sunk shadow bead lid designs while minimizing the likelihood of unintentional openings.

The second bend 175 may be positioned between 20 millimeters and 24 millimeters along the longitudinal axis L from the forward end 230. This carefully defined range ensures that the second bend 175 does not interfere with shadow bead geometries while maintaining compatibility with high-speed conversion press manufacturing system. A second bend 175 positioned closer to the nose portion 120 along the longitudinal axis L than 21 millimeters would likely conflict with shadow beads 48, disrupting stacking configurations and potentially leading to sponginess or coating abrasion during shipping. Conversely, the second bend 175 positioned further than 23 millimeters along the longitudinal axis would reduce the available under-tab finger access, diminishing the ergonomic benefits of the pull tab. The interaction between the first and second bends 170,175 within this range also creates an ergonomic upward contour for the lift portion 110, which optimizes force displacement, finger access, and manufacturability. These distances have been determined to support both stacking viability with shadow beads 48 and reliable manufacturability in high-speed conversion press environments.

The second bend 175 may be positioned about 22 millimeters along the longitudinal axis L from the forward end 230. This specific placement defines the total height $H_1$ of the pull tab and establishes the topmost plane $P_4$ of the lift portion 110, making it ideal for lids with angular shadow bead geometries. The second bend 175 being positioned closer to the nose portion 120 than 22 millimeters would create angles relative to the first bend 170 that are too sharp for reliable manufacturability in high-speed conversion presses, increasing tooling wear and production inefficiencies. Additionally, such positioning could compromise stacking compatibility with angular shadow beads 48. At about the 22 millimeter position, this second bend 175 position optimizes finger access by creating a functional under-tab access area while maintaining compatibility with the stacking requirements of angular shadow bead lids.

The second bend 175 may be positioned about 22.7 millimeters along the longitudinal axis L from the forward end 230. This placement is particularly suited to fully sunk shadow bead geometries, where the shadow bead 48 requires the second bend 175 to be located further along the longitudinal axis L for optimal stacking alignment. A second bend 175 positioned closer to the nose 120 than this distance would increase the risk of interference with the shadow bead 48 and create overly sharp angles that could compromise tooling durability in high-speed manufacturing processes. By setting the second bend at 22.7 millimeters, the design ensures that the lift portion achieves an effective upward contour that is both ergonomic for users and manufacturable with minimal tooling wear. This placement balances stacking compatibility, ergonomic usability, and reliable manufacturability for fully sunk shadow bead container designs. These dimensions were carefully selected based on targeted engineering analysis to achieve optimal functionality, stacking compatibility, and user accessibility. This specific design goes beyond routine choice, reflecting a purposeful balance between manufacturability and user-centered enhancements.

The first and second bends 170, 175 may collectively elevate the lift portion 110, such that the total height $H_1$ from the bottom plane $P_2$ to the lift portion top plane $P_4$ is about 1.5 millimeters, facilitating user actuation and stacking of container lids 40. This dual-bend structure is a novel feature that allows the pull tab 20 to achieve an elevated lift portion 110 at a precisely controlled height, facilitating both user accessibility and efficient stacking across a variety of container lid types. The 1.5 millimeter height has been carefully determined to ensure compatibility with the 1.7 millimeter spacing between end panels in predominantly used lid types. This precise height prevents the pull tab 20 from interfering with the stacked configuration, which could otherwise cause coating abrasion, lead to sponginess during shipping, and reduce stacking efficiency.

The dual-bend configuration is a significant advancement over single-bend pull tab designs. In easy access pull tabs, creating a single upward bend to achieve the required height for finger access can result in manufacturing inconsistencies and reduced precision in angle and height control. By incorporating two distinct, strategically placed bends 170, 175, the present design distributes the elevation gradually, enabling more precise control over the final height $H_1$ and angle of the lift portion 110. This approach minimizes tooling wear and allows for more consistent manufacturing outcomes, particularly in high-speed conversion press environments where tooling assemblies, such as a reform punch and die, are utilized to form these bends 170,175. The two bends 170,175 create a more controlled elevation that not only facilitates user access but also maintains structural alignment with the lid's stacking requirements.

This dual-bend design also addresses a key industry limitation with easy access pull tabs currently on the market. Existing easy access tabs tend to be stack-compatible with only certain lid types, typically those that use additional metal to increase the space between end panels. This increased metal use drives up manufacturing costs and reduces the economic viability of the product. The proposed invention, with a 1.5 millimeter dual-bend lift portion height, achieves universal stacking compatibility without excess metal, making it both cost-effective and versatile. This capability to stack efficiently on all major lid types, combined with improved finger access, establishes a new standard in easy access pull tab design, overcoming the primary challenges that have limited widespread adoption in the industry.

The lift portion 110 may be elevated above the top plane $P_1$ of the pull tab 20 and extends between each opposing side 143 of the pull tab 20, providing a continuous elevated surface for user interaction. This design enhances ergonomics and ease of use. This novel design fundamentally redefines how users interact with pull tabs 20 by elevating the entire lift portion 110 above the top plane $P_1$ of the pull tab 20, unlike prior art, which isolates bends within the lift portion itself. Traditional easy access pull tabs typically feature a small arc or square-back shape in the lift portion, concentrating user interaction to a limited area. This design restricts the under-tab finger access window and results in increased pressure on the finger due to limited surface area contact.

By placing upward bends 170,175 on the sides 143 of the pull tab 20 and elevating the entire lift portion 110, the present invention creates a significantly wider and more accessible finger access window, extending across the width of the pull tab 20. This design allows for more room under the pull tab 20, enabling multi-finger interaction, which distributes pressure across a larger area and reduces the strain felt by consumers during the opening process. The continuous elevation of the lift portion ensures that the geometry is less rounded than in prior art, providing a larger and more ergonomic surface for finger contact. This capability is a game-changer for user experience, as it allows consumers to open containers more comfortably and efficiently.

The upward bends 170,175 located on the sides of the pull tab 20 also optimize manufacturability. Unlike prior art designs with bends isolated in the lift portion, which interfere with carrier strips during the manufacturing process, the present invention is fully compatible with the ear carry method. This method, which is predominantly used in the industry for flat pull tabs, positions carrier strips on the lift portion 110 of the pull tab 20. By placing bends 170,175 on the sides 143, the present invention eliminates interference with carrier strips, making it feasible to retrofit existing conversion press systems with minimal cost compared to retrofitting for prior art designs. The dual bends 170,175 and elevated lift portion 110 offer a cost-effective solution that addresses a critical barrier to widespread adoption of easy access pull tabs.

Moreover, the present design allows for the maximum allowable finger access within the constraints of current lid designs, providing superior usability while maintaining compatibility with standard shadow bead geometries. Easy access pull tabs currently on the market often fail to achieve this balance, as their isolated bends create lift portions that remain partially flat and flush against the container lid. This limits both under-tab finger access and surface area interaction, reducing the ergonomic benefits for users. The present invention resolves these limitations by elevating the entire lift portion 110 and extending it uniformly across the width of the pull tab 20, creating a continuous surface for user interaction and improving the under-tab finger access dramatically.

The pull tab 20 may further comprise a third bend 178 at the rearward end 240 of the lift portion 110. The third bend 178 elevates the rearward end 240 of the lift portion 110 relative to the top plane $P_1$ of the pull tab 20, creating an ergonomic contour 190 that facilitates improved finger access. The third bend adds a contoured elevation that increases the surface area available for finger engagement. This feature provides additional leverage points for lifting, making the opening process smoother and more intuitive. The contour also enhances grip, which is a significant benefit for users preferring a firmer grasp.

The lift portion 110 may have a width $W_1$ between each opposing side 143 of between 11 mm and 16 mm. This width range has been determined to optimize finger access and user engagement across different container lid diameters, balancing functionality and manufacturability. A width $W_1$ closer to 11 millimeters is ideal for smaller-diameter lids 40, where a more compact design may be necessary to integrate effectively with existing conversion press systems. This narrower width may also allow for a rounded shape, compatible with smaller lids and user ergonomics. Conversely, a width $W_1$ closer to 16 millimeters is advantageous for larger-diameter lids 40, providing a broader surface for finger contact and facilitating multi-finger opening. This increased surface area reduces the pressure on the finger by distributing the force across a wider area, enhancing comfort during use. The defined range between 11 and 16 millimeters allows for design adaptability, ensuring compatibility with varying lid sizes while offering meaningful improvements in user accessibility and ergonomic flexibility.

The width $W_1$ of the lift portion 110 may be about 14 mm. This specific width provides an optimal balance between user comfort and material efficiency. This specific width $W_1$ has been identified as optimal for balancing all key aspects of usability, manufacturability, and ergonomic comfort. At 14 millimeters, the lift portion width $W_1$ provides a substantial finger access area, enabling a multi-finger opening process and reducing the perceived force required to open the container 30. A 14 millimeter width also offers a more continuous and less rounded surface compared to prior art, allowing consumers to engage with the pull tab more comfortably and efficiently. Additionally, this width ensures compatibility with existing manufacturing lines, minimizing the need for extensive modifications while maximizing user accessibility. By achieving this optimal width, the present invention enhances the user experience while maintaining manufacturability and cost-effectiveness An overall length $L_1$ of the pull tab 20 is preferably between 20 mm and 25 mm. This length range has been determined as ideal to accommodate different lid diameters while ensuring effective stacking and user accessibility. A length of 20 millimeters represents the shortest viable design that maintains the benefits of an elevated lift-end pull tab. Shortening the length below 20 millimeters would likely compromise stacking compatibility and reduce the ergonomic leverage provided by the distance from the lift end to the fulcrum. Conversely, a length closer to 25 millimeters supports optimal lever mechanics, enhancing the force distribution required to open a container while remaining compatible with current conversion press lines. This range balances user accessibility, ergonomic efficiency, and compatibility across a variety of lid diameters, making it suitable for both compact and larger lids in commercial applications.

The pull tab 20 may be manufactured using various methods, including stamping, casting, forging, or the like. The pull tab is most commonly manufactured in a conversion press, utilizing separate stations that stamp sheets of aluminum into the preferred embodiments. The bends may be formed through a lift station in a conversion press or in a separate station, such as the reform station. Surface treatments such as anodizing, powder coating, or the like may be applied to enhance durability and aesthetics.

While a particular form of the invention has been illustrated and described, it will be apparent that various modifications can be made without departing from the spirit and scope of the invention. Accordingly, it is not intended that the invention be limited, except as by the appended claims.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above Detailed Description section explicitly defines such terms.

Accordingly, the actual scope of the invention encompasses not only the disclosed embodiments, but also all equivalent ways of practicing or implementing the invention.

The above detailed description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

Changes can be made to the invention in light of the above "Detailed Description." While the above description details certain embodiments of the invention and describes the best mode contemplated, no matter how detailed the above appears in text, the invention can be practiced in many ways. Therefore, implementation details may vary considerably while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated.

While certain aspects of the invention are presented below in certain claim forms, the inventor contemplates the various aspects of the invention in any number of claim forms. Accordingly, the inventor reserves the right to add additional claims after filing the application to pursue such additional claim forms for other aspects of the invention.

What is claimed is:

1. A pull tab for opening a container having a container lid with a frangible region and a rivet, the pull tab comprising:

a body having a forward end that includes a nose portion, a rearward end that includes a lift portion, a pair of opposing sides extending from the nose portion to the lift portion, a top surface defining a top plane, and a bottom surface defining a bottom plane, a longitudinal axis of the body being defined between the forward end of the body and the rearward end of the body the body being tapered such that a thickness of the body at the nose portion between the top surface and the bottom surface is thicker than a thickness of the body between the top surface and the bottom surface at the lift portion;

a rivet island aperture formed in the body between the opposing sides of the body proximate the nose portion, the rivet island aperture defining a rivet island of the body that includes a rivet aperture for attachment with the container lid, and a transition area between the rivet aperture and the forward end;

a first bend formed in the body between the nose portion and the lift portion;

a second bend formed in the body between the rearward end of the body and the first bend, the lift portion being disposed between the rearward end of the body and the second bend, the first and second bends collectively elevating the lift portion above the top plane of the body, an intermediate portion of the body defined between the first bend and the second bend, the bottom surface of the lift portion defining a lift portion bottom plane, and the top surface of the lift portion defining a lift portion top plane, the lift portion top plane being substantially parallel to the bottom plane of the body;

wherein the top plane and the bottom plane form an angle of between 2 degrees and 10 degrees from the nose portion to the first bend;

wherein a total height from the bottom plane to the lift portion top plane is between 1 millimeter and 4 millimeters;

whereby when the lift portion is lifted away from the container lid, the nose portion applies downward pressure on the frangible region of the container lid to open the container.

2. The pull tab of claim 1 further including a finger hole formed in the body between the opposing sides of the body between the rearward end of the body and the rivet island aperture.

3. The pull tab of claim 1 wherein the angle is between 4 degrees and 5 degrees.

4. The pull tab of claim 1 wherein the angle is about 4.34 degrees.

5. A pull tab for opening a container having a container lid with a frangible region and a rivet, the pull tab comprising:

a body having a forward end that includes a nose portion, a rearward end that includes a lift portion, a pair of opposing sides extending from the nose portion to the lift portion, a top surface defining a top plane, and a bottom surface defining a bottom plane, a longitudinal axis of the body being defined between the forward end of the body and the rearward end of the body;

a rivet island aperture formed in the body between the opposing sides of the body proximate the nose portion, the rivet island aperture defining a rivet island of the body that includes a rivet aperture for attachment with the container lid, and a transition area between the rivet aperture and the forward end;

a first bend formed in the body between the nose portion and the lift portion;

a second bend formed in the body between the rearward end of the body and the first bend, the lift portion being disposed between the rearward end of the body and the second bend, the first and second bends collectively elevating the lift portion above the top plane of the body, an intermediate portion of the body defined between the first bend and the second bend, the bottom surface of the lift portion defining a lift portion bottom plane, and the top surface of the lift portion defining a lift portion top plane, the lift portion top plane being substantially parallel to the bottom plane of the body;

wherein a total height from the bottom plane to the lift portion top plane is between 1 millimeter and 4 millimeters;

whereby when the lift portion is lifted away from the container lid, the nose portion applies downward pressure on the frangible region of the container lid to open the container;

wherein the body includes a variable thickness profile along the longitudinal axis between the nose portion and the first bend, the body being tapered such that:

a thickness of the body at the nose portion between the top surface and the bottom surface is greater than a thickness of the body between the top surface and the bottom surface at the lift portion;

the thickness of the body between the top surface and the bottom surface increases from the nose portion to an intermediate peak thickness located between the nose portion and the first bend; and the thickness of the body between the top surface and the bottom surface tapers from the intermediate peak thickness to the lift portion.

6. The pull tab of claim 5, wherein the body includes a variable thickness profile along the longitudinal axis between the nose portion and the first bend, the thickness increasing from about 1.35 millimeters at the nose portion to approximately 1.5 millimeters at an intermediate peak before tapering to around 0.75 millimeters at the lift portion.

7. The pull tab of claim 5, wherein an angle formed between the bottom plane and the top plane of the body, extending from the first bend to a topmost point of the tab at a peak thickness, varies between 0.2 degrees and 5.6 degrees.

8. The pull tab of claim 7, wherein the angle between the bottom plane and the top plane from the first bend to the topmost point of the tab is between 1.5 degrees and 2.5 degrees.

9. The pull tab of claim 8, wherein the angle between the bottom plane and the top plane from the first bend to a topmost point of the tab is about 2.1 degrees.

10. The pull tab of claim 5 wherein the intermediate portion of the body forms an angle with the top plane of between 5 degrees and 35 degrees.

11. The pull tab of claim 10 wherein the angle is about 15 degrees.

12. The pull tab of claim 5 wherein the intermediate portion of the body forms an angle with the lift portion top plane of between 10 degrees and 45 degrees.

13. The pull tab of claim 12 wherein the angle is about 13 degrees, wherein the lift portion top plane is substantially parallel to the bottom plane.

14. The pull tab of claim 5 wherein a vertical distance from the lift portion top plane to the lift portion bottom plane is between 0.5 millimeters and 1 millimeter.

15. The pull tab of claim 14, wherein the vertical distance from the lift portion top plane to the lift portion bottom plane is between 0.7 millimeters and 0.8 millimeter.

16. The pull tab of claim 5 wherein the thickness at the nose portion is between 1 millimeter and 2 millimeters.

17. The pull tab of claim 16, wherein the thickness of the nose portion is between 1.2 millimeters and 1.8 millimeters.

18. The pull tab of claim 17, wherein the thickness of the nose portion is about 1.35 millimeters.

19. The pull tab of claim 5 wherein the first bend is positioned between 19.25 millimeters and 21.5 millimeters along the longitudinal axis from the forward end.

20. The pull tab of claim 19, wherein the first bend is positioned about 19.3 millimeters along the longitudinal axis from the forward end.

21. The pull tab of claim 19, wherein the first bend is positioned about 21.5 millimeters along the longitudinal axis from the forward end.

22. The pull tab of claim 21, wherein the second bend is positioned about 22.7 millimeters along the longitudinal axis from the forward end.

23. The pull tab of claim 5 wherein the second bend is positioned between 21 millimeters and 23 millimeters along the longitudinal axis from the forward end.

24. The pull tab of claim 23, wherein the second bend is positioned about 22 millimeters along the longitudinal axis from the forward end.

25. The pull tab of claim 5 wherein the first and second bends collectively elevate the lift portion, such that the total height from the bottom plane to the lift portion top plane is about 1.5 millimeters, facilitating user actuation and stacking of container lids.

26. The pull tab of claim 5 wherein the lift portion is elevated above the top plane of the pull tab and extends between each opposing side of the pull tab, providing a continuous elevated surface for user interaction.

27. The pull tab of claim 5 further comprising a third bend at the rearward end of the lift portion, the third bend elevating the rearward end of the lift portion relative to the top plane of the pull tab, creating an ergonomic contour that facilitates improved finger access.

28. The pull tab of claim 5 wherein the lift portion has a width between each opposing side of between 11 mm and 16 mm.

* * * * *